United States Patent [19]

Foster

[11] 4,395,784

[45] Aug. 2, 1983

[54] TOILET SEAT AND LID SAFETY LOCK

[75] Inventor: Tracey L. Foster, Gloster, Miss.

[73] Assignee: Howard C. Camp, Huntsville, Ala.

[21] Appl. No.: 318,579

[22] Filed: Nov. 5, 1981

[51] Int. Cl.[3] ..... A47K 13/12

[52] U.S. Cl. ..... 4/236; 4/240; 292/228

[58] Field of Search ..... 4/234–240, 4/253; 292/228; 16/297, 322, 327, 352, 333, 343

[56] References Cited

U.S. PATENT DOCUMENTS 2,431,263 11/1947 Lundgren ..... 4/236

*Primary Examiner*—Stephen Marcus
*Assistant Examiner*—Kenneth S. Putnam

[57] ABSTRACT

A rectangular shaped lock-block with its forked interface hinge which is joined by a common axle which also serves to hold the interface hinge firmly against the toilet seat and lid and hold the lock-block device firmly against the rear of the toilet basin behind the toilet seat. The lock-block device houses a spring-latch mechanism with a removable compression spring which is held in place by a set screw located at the rear of the lock-block device. The compression spring exerts a constant pressure against the latch which is forced under the interface hinge holding it and the toilet seat lid in the down locked position. The latch must be retracted before the lid and seat can be raised. Once the hinge and lid are raised out of the locked down position, the spring forces the latch to ride against the rotating hinge and automatically relocks when the lid is lowered to the down position.

11 Claims, 6 Drawing Figures

TOILET SEAT AND LID SAFETY LOCK

ORIGIN OF THE INVENTION

The invention described herein was made by Tracey L. Foster, a citizen of the United States and a resident of Gloster, State of Mississippi, whose post office address is Box 555, Gloster, Mississippi 39638.

BACKGROUND OF THE INVENTION

This invention relates to a practical, economically produced, and reliable safety device which can be used to deter toddlers and very young children from falling into or throwing toys and other large objects into toilet basins. With such a device being unknown to the inventor and in the wake of a drowning tragedy involving a one-year-old child, the inventor conceived and developed the Toilet Seat and Lid Safety Lock.

The locking device is designed to adapt to and function on most standard toilet seats. Simple installation is required. Another requirement is that it have sufficient strength and durability to withstand the pull of a small child, and that it be made of non-corrosive materials and provide normal operation in the normal bathroom temperature and humidity environment.

SUMMARY OF TH INVENTION

In the present invention is basically a rectangular shaped lock with a transverse axle through its front to which hinges are mounted and which utilized a string-latch which slides underneath the bottom of the Hinge(s) automatically locking the hinge(s) in the down or horizontal position until the latch is released. The hinge(s) interface with the rear of the toilet seat lid thus preventing the lid and the toilet seat from being raised. The device is secured in position by running the transverse axle rod on the rear of the toilet seat through the interface hinge and the front of the lock-block, or in the absence of the axle rod, the lock-block is held in position by the toilet seat anchor bolts which pass through a removable stop which transverses and is attached to its bottom; or in the alternative if it is used to replace an anchor bolt and hinges on a seat, it may be secured to the basin by its own anchor bolt. Although it is easy for an adult or an older child to simultaneously operate the latch and raise the toilet lid and seat, it is virtually impossible for a small child to accomplish. When the lid is lowered, the spring latch automatically locks it in the down position unless the lockout catch has been positioned to hold the latch in the non-automatic mode.

The design of the safety lock is simple and such that a minimum number of parts is required and a minimum amount of tooling, machining, and assembly time is required in its manufacture and production. The lock-block consists of two (2) blocks which are mated, between which the spring and latch are located. For ease in manufacturing only the bottom block is recessed to accommodate the latch, and both the top and bottom blocks are recessed to accommodate the spring which lies parallel and slightly off-center to the longitudinal centerline of the device. The spring is held in place by a set screw at the rear. The latch is held in place by a double pin which passes through its fulcrum. The top block has a hold at its front to accommodate its axle rod or the axle rod of the toilet set, if one exists, which is transverse to the centerline of the block. The device may be made from brass or other non-corroding metals or it may be made from a variety of plastics such as nylon, teflon, Lexon, Delvin, etc. The method of manufacture may be by machining either metal or plastic stock or by plastic molding. For more cost effectiveness in large production runs, injection molding using plastics is recommended; however, for smaller runs, machining from plastics stock is recommended. The upper and lower halves of the locking device are interfaced and secured together by screws or by plastic bonding, depending upon the method of manufacture; i.e., molding or machining. The bottom block also has a countersunk hole through its bottom through which an anchor bolt may be inserted if the device is to be used as a replacement or substitute for existing hardware and anchor bolt on the toilet seat. The hinges and fixtures may be made from the same materials as the lock-block and may be either machined or molded, and the design is unique in that it has a forked hinge and in most applications no screws or other hardware are required to secure the toilet lid interface hinge to the toilet lid.

It is therefore the object of this invention to provide a safety locking device to prevent small children from accidentally falling into toilet basins and drowning.

Yet another object is to provide a safety locking device which will deter small children from throwing toys or other large objects into toilet basins and otherwise causing damage and often expensive plumbing and maintenance costs.

Yet another object is to provide a safety locking device which automatically relocks the toilet seat and lid without any conscious effort of a user and which is easy for an adult or older child to unlock and raise, but extremely difficult for a toddler or very young child to unlock and raise.

Yet another object is to provide a toilet seat and lid safety locking device which is economically affordable and which is easy to install.

Yet another object is to introduce and include in the patent the forked interface hinge which may have multiple applications and uses.

Other objects and advantages of the invention will be apparent from the following detailed description and the appended claims.

Yet another object is to provide an automatic-locking device which may easily be converted to the non-automatic-locking mode to allow normal operation of the toilet seat and lid when the requirement for automatic locking does not exist.

DESCRIPTION OF THE PREFERRED EMBODIMENT

Figure 1:
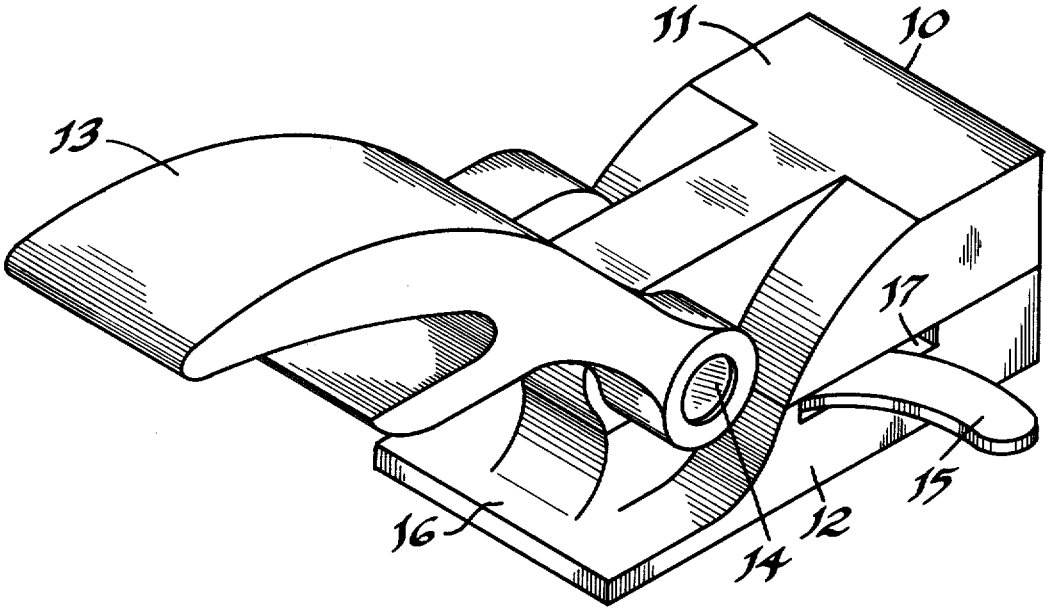
FIG. 1 is an isometric view showing a spring latch lock block and interfacing hinge embodying the invention.
Figure 2:
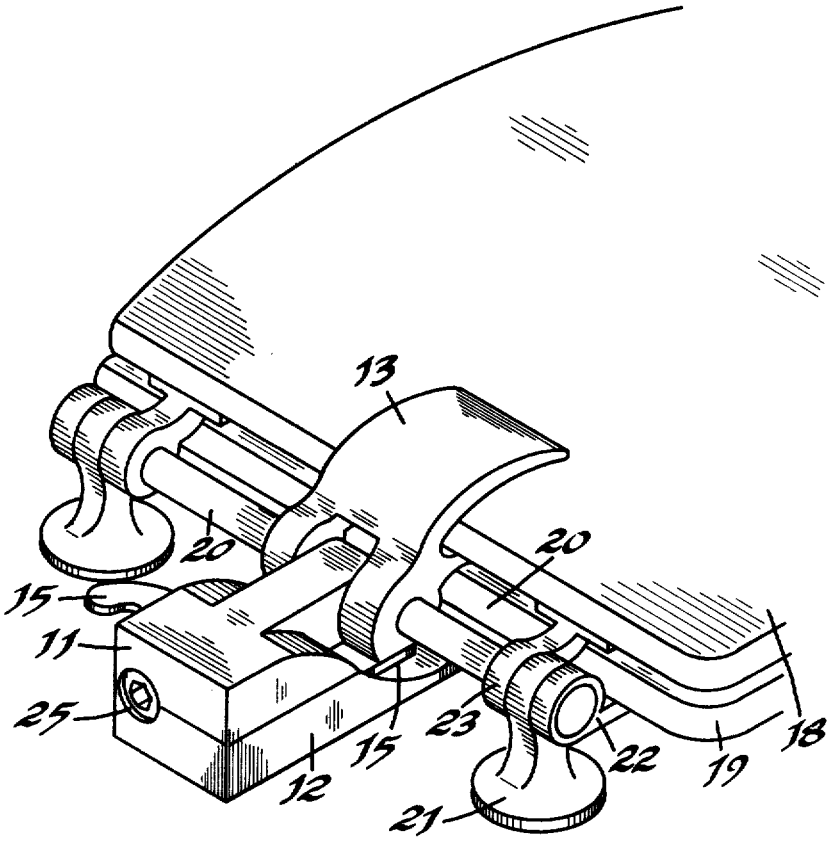
FIG. 2 is an isometric view showing the lock and interfacing hinge attached to a toilet seat by means of the toilet seat transverse axle passing through the interface hinges and lock block.
Figure 3:
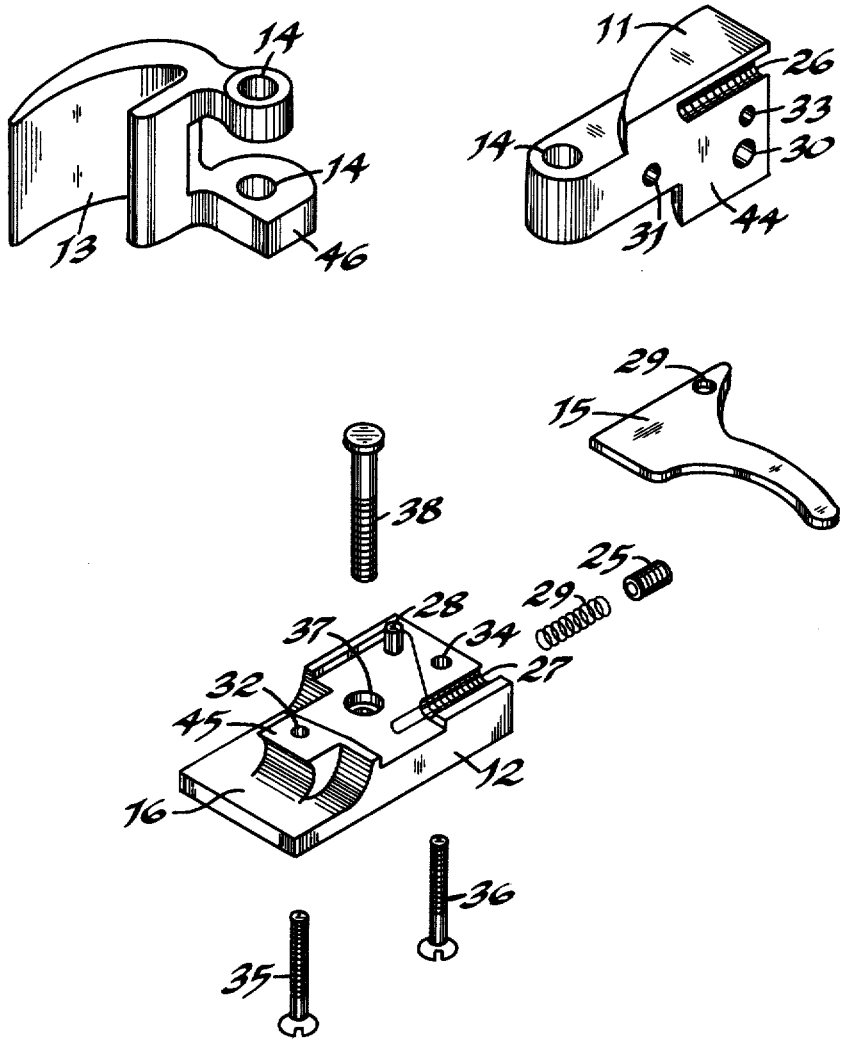
FIG. 3 is an isometric exploded view of the invention showing the various parts and their relationship to each other.
Figure 4:
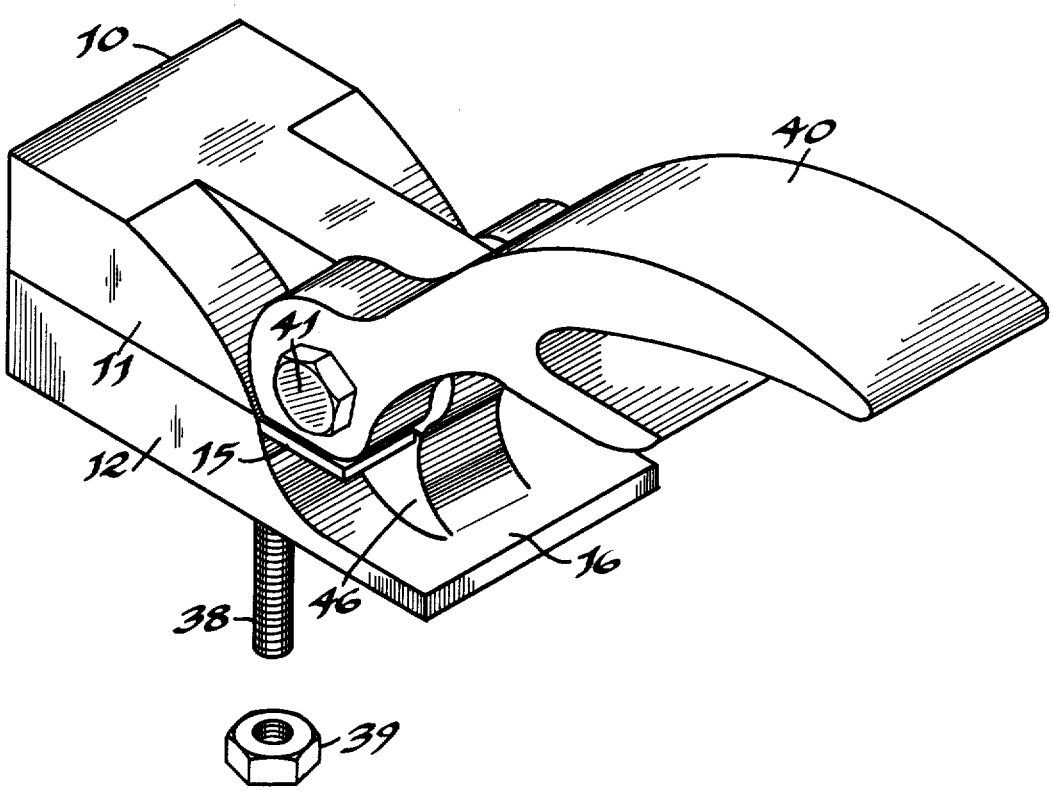
FIG. 4 is an isometric view showing the device when it is used to replace one set of hinges and anchor bolt on the toilet seat and using the optional anchor bolt and the optional single attachment interface hinge.
Figure 5:
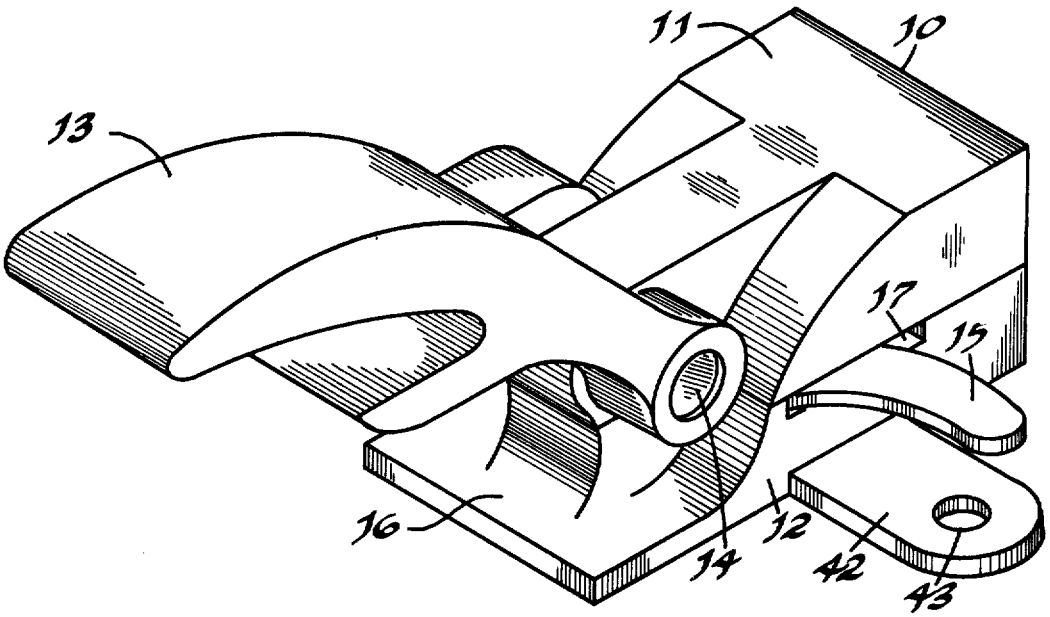
FIG. 5 is an isometric view showing the device using the optional transverse strap which holds it in position by passing the toilet seat anchor bolts through the stops thus allowing its operation without attaching the hinge to the seat lid even in the absence of the traditional transverse axle rod on the toilet seat installation.

Referring to FIGS. 1 through 6 in the drawings, a toilet seat and lid safety lock is indicated generally by the numeral 10. The spring latching mechanism is housed in generally rectangular blocks 11 and 12 adapted to be assembled with side 44 of block 11 and side 45 of block 12 in face-to-face relation. Block 12 forms the bottom and is routed out on side 45 to accommodate the one-piece latch and lever 15 which is held in place by a dowel pin 28 which passes through a hole in its fulcrum 29 and into a hole 30 in the top interfacing block 11. Blocks 11 and 12 have recesses 26 and 27 which when mated will accommodate a removable spring 29 which is held in place by a set screw 25. The mated blocks 11 and 12 are held together holding the latch and spring in place either by plastic bonding or by screws 35 and 36 which pass up through holes 32 and 34 in the bottom block 12 into holes 31 and 33 in the bottom of the top block 11. The countersink hole 37 in the bottom block 12 accommodates the optional anchor bolt 38 which may be included at assembly, or it may be tapped from the bottom and the appropriate anchor bolt may be secured into hold 37 after assembly.

A hole 14 runs transversely through the top front of block 11 which allows the device to be secured into position behind the toilet seat by passing the transverse axle rod 20 of the toilet seat through the hole 14; or in the absence of the axle rod 20 in the toilet seat installation the device may be held in position by using the optional strap 42 and passing the anchor bolts through the holes 43 at each end of the strap. A second alternative in the absence of the axle rod 20 in the toilet seat installation is to secure the toilet seat lid interface hinge 13 to the toilet seat lid 18 with screws and then secure the device into position by attaching the hinge 13 and the locking device together by inserting its own axle bolt 41 through holes 14 in the respective parts 13 and 11.

The bottom of block 12 has a lip or extension 16 which extends forward beyond a vertical plane which extends through the centerline of the transverse axle rod 20 or 41 thus preventing any rotation of the device 10 about the axle 20 without any further restraint.

With the spring-latch lock-block 10, the forked interface hinge 13 and the toilet seat lid 18 effectively joined together the spring latch 15 is held under the flat surface 46 of the interface hinge 13 and 40 and prevents the toilet seat or lid from being raised until the latch lever 15 is pulled from the latched position. The spring 25 forces the latch against the rotating interface hinge when it is in the up or unlocked position and as the lid and interface hinge are lowered to the full down or horizontal position the latch is again automatically forced into the locked position.

One side of block 12 accommodates a beveled slot 45 which houses a free floating beveled lockout catch 47 which may be slipped up in front of the latching lever 15 thereby holding the latch in the retracted position, thus converting the lid and seat assembly from automatic locking to the non-automatic locking mode. The force of the latching lever 15 against the lockout catch 47 holds the catch in the locked out position. The latching lever may be returned to the automatic locking mode by pushing down on the lockout catch.

Figure 6:
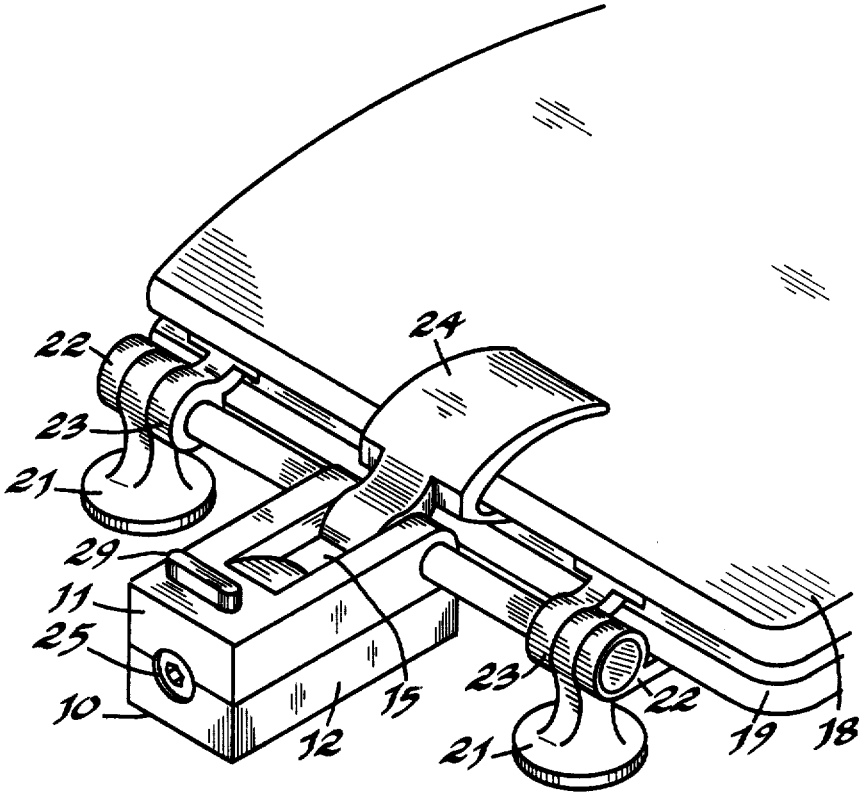
FIG. 6 is an isometric view of a modified lock and hinge which embodies the same principles as those in FIGS. 1 through 5; however, the spring latch is located in the center of the lock-block and allows the utilization of a broader locking latch and interface area between the latch and the lid interface hinge. It is attached to and interfaced with the toilet seat as with FIG. 2 and FIG. 5 and also utilizes the forked hinge which interfaces with the toilet seat lid.

In addition to the embodiment described in detail above, the invention includes other toilet seat and lid safety lock arrangements. For example, a center-located spring latch with a more broad interface area with the bottom surface of the interface hinge, as depicted in FIG. 6, thus providing more strength and stability to the more heavily designed toilet seat installations. Such arrangement could provide as much as 4½ linear inches of latch and hinge interface area.

It is to be understood that the locking device described in detail above is given only as exemplary and that various changes and modifications thereof can be employed without departing from the scope of the invention.

I claim:

1. An automatically locking toilet seat and lid safety lock comprising:

(a) a seat member, said seat member including at least one hinge receiving element said seat member pivoting about an axle, said axle having a longitudinal axis;

(b) a spring-latch locking mechanism said locking mechanism being enclosed in a pair of generally rectangular blocks, said blocks being assembled in a face-to-face relation with a first of said blocks forming a top and a second of said blocks forming a bottom of a lock block device, said blocks being secured together;

(c) a forked hinge member joining said lock block to said seat member wherein said lock block accommodates an axle member for joining the lock block to said forked hinge;

(d) the top of said second block being recessed to accommodate a single piece latch and lever, said single piece latch and lever pivoting about a fulcrum, said second block further having a bottom lip which extends forward of a vertical plane which extends through the longitudinal axis of the axle;

(e) both of said blocks being grooved in a manner such that when mated together they will accommodate a compression spring which is held in place by a set screw at a rear portion of the lock block device, said spring exerts a constant pressure on said single piece latch and lever thus assuring automatic locking when the forked hinge and seat are in a down position;

(f) a tie-down strap which extends laterally from the sides of said second block, said strap having holes through which the seat anchor bolts pass thus securing the lock in position;

(g) a single dowel pin passing between both of said blocks through the fulcrum of the single piece latch and lever thus holding said latch and lever in place, (h) both of said blocks are externally relieved on a radius which allows the rotation of the forked hinge around said axle (i) said single piece latch and lever has a lever projection and also a latch projection which extends into the externally relieved area and makes contact with a flat bottom surface of the forked hinge, said contact prohibits rotation of said forked hinge about the axle thereby locking the seat in a down position until the latch projection is pulled out of contact with the forked hinge by applying force to the lever projection.

2. The automatically, locking toilet seat and lid safety lock as described in claim 1 wherein said axle is an existing-axle about which said toilet seat pivots.

3. The automatically locking toilet seat and lid safety lock of claim 1 wherein said axle is added to said seat structure along with said lock block device.

4. The automatically locking toilet seat and lid safety lock of claim 1 wherein said safety lock is secured in position by the seat anchor bolts passing through a transverse tie-down strap.

5. The automatically locking toilet seat and lid safety lock of claim 1 wherein said safety lock is secured in position by an existing axle about which said toilet seat pivots.

6. The automatically locking toilet seat and lid safety lock of claim 1 wherein said blocks are secured together by plastic bonding.

7. The automatically locking toilet seat and lid safety lock of claim 1 wherein said blocks are secured together by male threaded screws through threaded holes in both of said blocks.

8. The invention as defined in claim 1 wherein said toilet seat and lid safety lock may be made of plastic, metal, or a combination of plastic and metal.

9. The invention as defined in claim 1 wherein said compression spring may be removed by said set screw.

10. The invention as defined in claim 1 wherein said latch projection extends from the center of the lock block.

11. The invention as defined in claim 1 wherein said latch projection extends from the side of the lock block.

* * * * *